US005651153A

United States Patent [19]

Goodrich

[11] Patent Number: 5,651,153

[45] Date of Patent: Jul. 29, 1997

[54] WATER BED MATTRESS SHEET ANCHOR SYSTEM

[76] Inventor: Deborah J. Goodrich, 55430 M-51 Highway West, Decatur, Mich. 49045

[21] Appl. No.: 547,137

[22] Filed: Oct. 24, 1995

[51] Int. Cl.[6] ..... A47C 21/02

[52] U.S. Cl. ..... 5/498; 24/72.5; 5/504.1; 5/658

[58] Field of Search ..... 5/494, 496, 498, 5/658; 24/72.5

[56] References Cited

U.S. PATENT DOCUMENTS

| | | | |
|---|---|---|---|
| 2,155,690 | 4/1939 | Simpson | 5/498 |
| 4,316,299 | 2/1982 | Friedman | 5/485 |
| 4,384,380 | 5/1983 | Glaha et al. | 5/485 |
| 4,574,412 | 3/1986 | Smith | 5/436 |
| 4,606,290 | 8/1986 | Marzotto | 5/498 |
| 4,686,726 | 8/1987 | Dunfee | 5/485 |
| 4,698,880 | 10/1987 | Hamm | 5/498 |
| 4,736,478 | 4/1988 | Dangerously | 5/485 |
| 4,891,856 | 1/1990 | Thornhill | 5/498 |
| 5,072,470 | 12/1991 | Lysiak | 5/498 |
| 5,148,560 | 9/1992 | Torres | 5/496 |
| 5,179,743 | 1/1993 | Lanman | 5/498 |

*Primary Examiner*—Flemming Saether
*Assistant Examiner*—Robert G. Santos

[57] ABSTRACT

The invention is a polymeric frame that may fit completely under a water bed mattress or alternatively under the edge of the mattress and includes members that project at the corners of the mattress and secure a resilient member at each corner which then applies a retractive force to a device that grasps the mattress sheet and secures it in place. The water bed mattress sheet is thereby held firm and secure.

3 Claims, 2 Drawing Sheets

WATER BED MATTRESS SHEET ANCHOR SYSTEM

BACKGROUND OF THE INVENTION

1. Field of the Invention

This invention relates generally to bed coverings and in particular to a system for anchoring sheets on water beds.

2. The Problem and Relevant Prior Art

Changing the bottom sheet on a water bed can be a challenging task, particularly for women who are small, older or frail, in that it requires the changer to lift the heavy, water filler corner of the mattress in order to slip the sheet under. In addition, the water filled mattress of the water bed is not particularly conducive to sheet retention. The smooth plastic surface along with the changing shape and dimensions of the mattress tends to allow the bottom sheet escape from the conventional entrapment between the mattress and bed frame that holds the bottom sheet in place. The invention provides a novel system for anchoring the corners of sheets on a water bed that does not require the mattress to be moved, and resists the aforedescribed effects that cause sheets to pull out and become loose.

The prior art is devoid of any effective system for anchoring the corners of bedding that is designed and used between the sleeper and the mattress material. Examples of attempts to address the problem are shown in U.S. Patents as for example U.S. Pat. No. 4,316,299 issued Feb. 23, 1982 to Friedman who discloses a fitted bed covering; U.S. Pat. No. 4,384,380 issued May 24, 1983 to Glaha et al. shows another form of bed sheet construction; U.S. Pat. No. 4,574,412 issued Mar. 11, 1986 to Smith for a system for anchoring a pillow to a sheet; U.S. Pat. No. 4,686,726 issued Aug. 18, 1987 to Dunfee for a waterbed sheet and a means for inserting the sheet to restrain the sheet from wrinkling, folding, creasing or slipping, and U.S. Pat. No. 4,736,478 issued Apr. 12, 1988 to Dangerously for a waterbed sheet that includes a fitted corner with a bar located diagonally across the corner beneath the mattress.

The instant invention as disclosed and claimed herein provides distinct and useful advantages not previously known to the prior art.

SUMMARY OF THE INVENTION

The invention is characterized by a clamping device located at each corner of the mattress, resiliently attached to a frame which underlies, in one form the entire mattress and in another form the perimeter of the mattress. In order to install the frame under the entire mattress it is necessary that the water be drained and the plastic shell removed. This lengthy and cumbersome procedure can be avoided by using the perimeter frame which is in two locking pieces and merely requires that the edge of the mattress be lifted one time for installation. The resilient members are each attached to the frame which underlies the mattress on two sides adjacent the intersection of the sides, thereby centering the clamping device and causing the retractive force of each clamp to be directly opposed to the clamp in the corner diagonally across the mattress which will translate in the four corners, to a sheet that will lie smooth and flat and resist the forces normally generated by the motions of sleeping individuals.

It is therefore an object of the invention to provide a new and improved water bed mattress sheet anchor system.

It is another object of the invention to provide a new and improved water bed mattress sheet anchor system that will secure a sheet and resist the normal movements and motions of persons sleeping in a water bed.

It is a further object of the invention to provide a new and improved water bed mattress sheet anchor system that is safe to use and will not cause injury to persons sleeping in the water bed.

It is still another object of the invention to provides new and improved water bed mattress sheet anchor system that is simple to operate and easy to use.

It is still a further object of the invention to provide a new and improved water bed mattress sheet anchor system that has all the advantages of like prior art devices and none of the disadvantages.

It is another object of the invention to provide a new and improved water bed mattress sheet anchor system which may be easily and efficiently manufactures and marketed.

These, together with other objects of the invention, along with the various features of novelty which characterize the invention, are pointed our with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
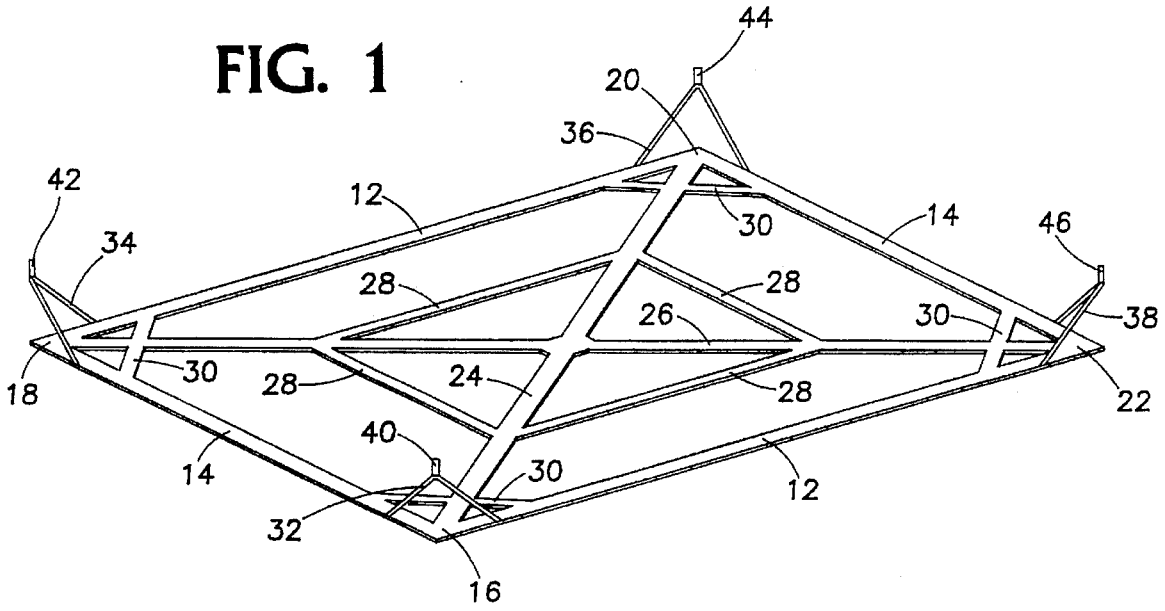
FIG. 1 is a perspective view of one embodiment of the invention.

Referring now to FIG. 1, the invention is shown generally at 10. The frame consists of a plurality of members having a generally rectangular cross section, with overall dimensions that are substantially congruent to the size and shape of a water bed. The frame members include longitudinal members 12 and transverse members 14 that intersect at right angles at the four corners, 16,18,20 and 22. Cross members 24 and 26 join and stabilize diagonally opposed corners. An internal quadrilateral shaped reinforcing member is formed of sides 28 aids in maintaining the shape of the outside frame member as do corner reinforcing members 30. Resilient, retractive force generating members 32,34,36,38 are attached to the frame members on two sides and support the sheet grasping clamp 40,42,44,46 respectively. The sheet clamp is translatable along the length of the resilient member. The resilient member may be any conventional form of appropriate elastic member currently available on the wholesale or retail market. The frame is preferably formed of a polymeric material, however a metal would work equally as well.

Figure 2:
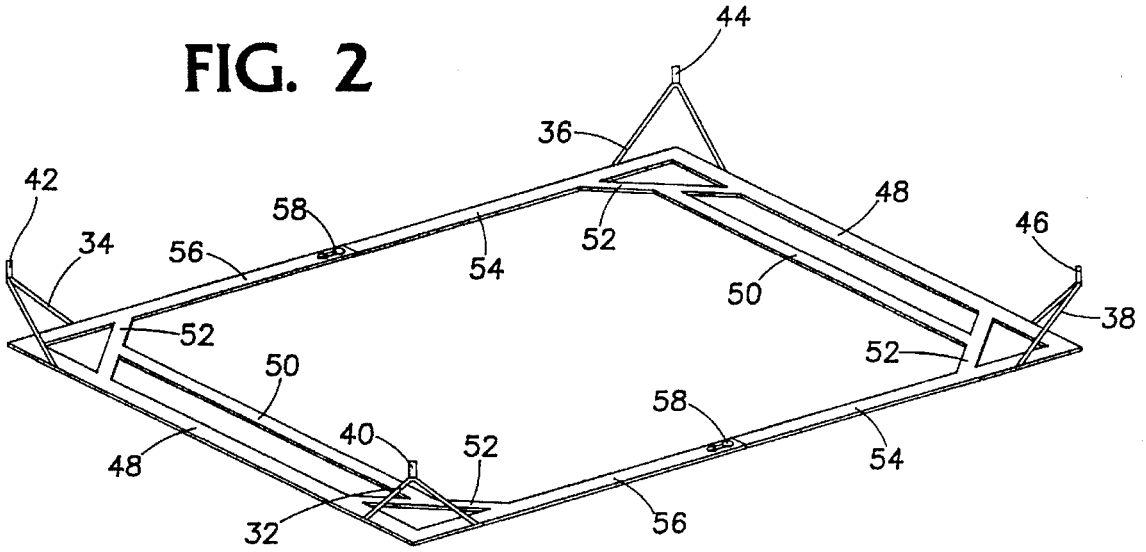
FIG. 2 is a perspective view of an alternative view of the invention.

An alternative embodiment of the invention is shown in FIG. 2. This embodiment is designed primarily for use where the mattress is filled with water. The use the embodiment of FIG. 1 would require that the mattress be emptied and then refilled at the time of installation.

Figure 4:
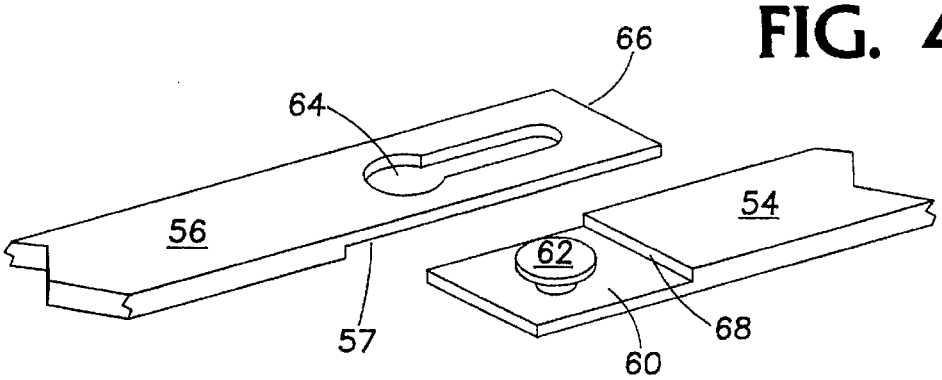
FIG. 4 is an enlarged view of the frame connection of the alternative form of the invention before assembly.
Figure 5:
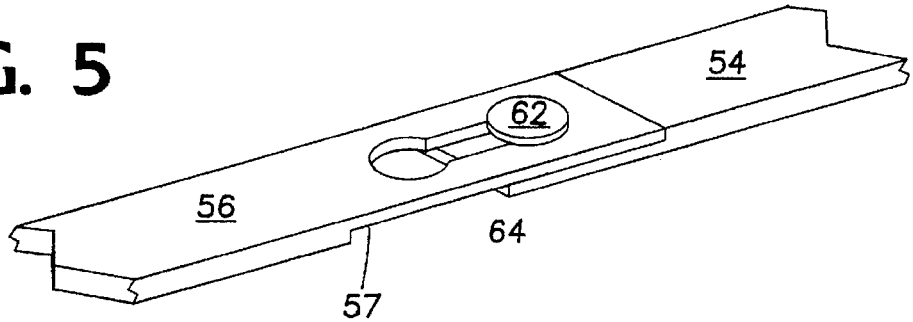
FIG. 5 is an enlarged view of the frame connection of the alternative form of the invention after assembly.

This frame includes transverse members 48, support members 50 and diagonal corner support members 59. Longitudinal members are in two sections 54 and 56 and are connected at joint 58, the resilient members 32,34,36,38 are attached to the frame in the same manner as described with regard to FIG. 1. The sheet grasping clamps 40,42,44,46 engage the resilient members in the same manner as described with regard to FIG. 1. The frame is diassembled into two sections for installation. The head end of the mattress is raised and the frame slipped under, the procedure is repeated for the foot end of the mattress. The simple locking mechanism shown in FIGS. 4 and 5 illustrate one manner of securing the sections of the frame. Frame member 54 includes a recessed area 60 from which a flare headed post 62 rises. Frame member 56 includes a keyhole shaped aperture 64 and a mating recessed area 57. The joint 58 is formed by placing the enlarged opening of the keyhole 64 and allowing the shank of the post 62 to engage the narrow portion of the keyhole 64 until the end 66 of the member 56 abuts the wall 68 of the recess 60. Where the materials are polymeric or light metal sufficient flexibility exists where the parts will shape themselves to perform the manipulation of locking and unlocking as necessary.

Figure 3:
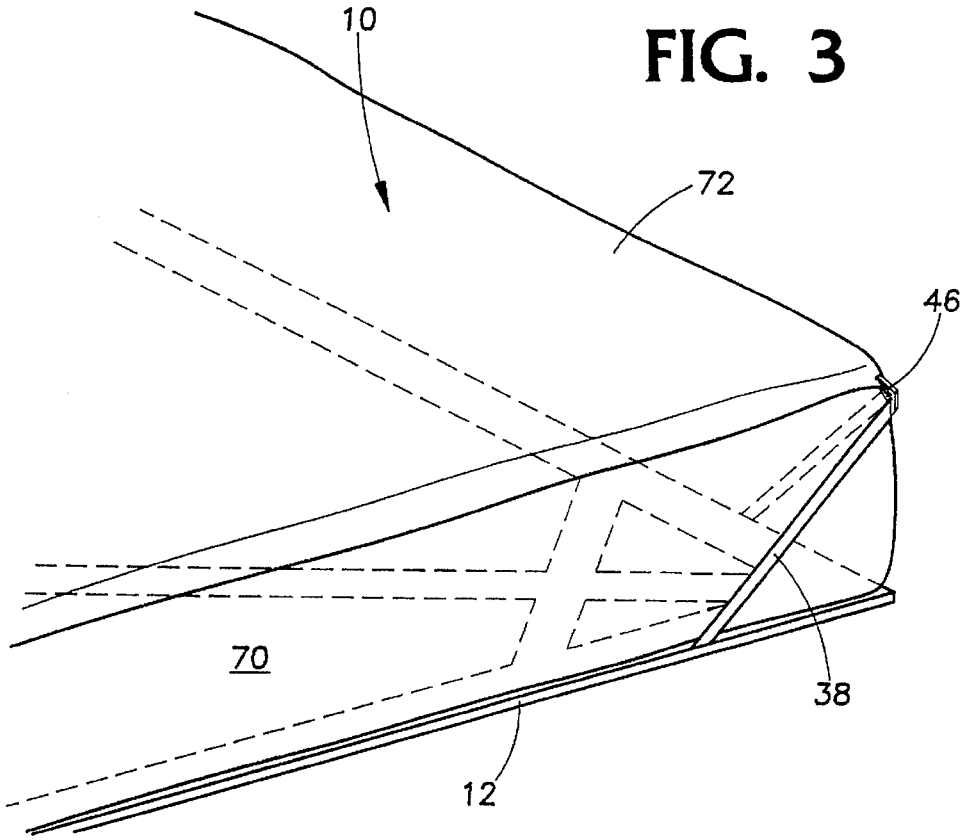
FIG. 3 is an isometric view of one corner of the invention.

Concerning FIG. 3, a water filled mattress 70 rests atop the frame 10, frame member 12 is at the perimeter of the mattress and secures elastic, resilient member 38. Sheet 72 covering the mattress is secured on the corner by grasping member 46 which applies a constant force to the sheet regardless of the motion of the water mattress or the person resting on the mattress. The grasping means is one of a conventional variety of material grasping means that are currently available on the retail and wholesale markets and may be of the spring biased type or of the double action locking type that are common and otherwise well known in the art.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. A waterbed sheet anchor system comprising:

a frame having the size and dimension of a waterbed mattress wherein the frame includes, a pair of spaced first parallel longitudinal members and a pair of spaced first parallel transverse members forming an outside rectangle joined orthogonally at their ends, diagonal support members joining opposed corners of said outside rectangle;

a pair of spaced second parallel longitudinal members and a pair of spaced second parallel transverse members forming an inside rectangle, joined orthogonally at their ends, and intersecting said diagonal support members;

elastic resilient member having two ends, attached to one of said first longitudinal outside member on one end and one of said first transverse outside member on the opposed end, at each corner of the frame, and a material grasping means attached to the elastic resilient means, and translatable between the ends for anchoring a waterbed mattress sheet.

2. A waterbed sheet anchor system according to claim 1 wherein: the frame is formed of metal.

3. A waterbed sheet anchor system according to claim 1 wherein: the frame is formed of polymeric material.

* * * * *